US006921203B2

(12) United States Patent
Versluys

(10) Patent No.: US 6,921,203 B2
(45) Date of Patent: Jul. 26, 2005

(54) STAND-UP POUCH WITH LEGS

(75) Inventor: Robert Thor Versluys, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 73 days.

(21) Appl. No.: 10/292,738

(22) Filed: Nov. 12, 2002

(65) Prior Publication Data

US 2004/0091182 A1 May 13, 2004

(51) Int. Cl.[7] ..... B65D 30/10

(52) U.S. Cl. ..... 383/104; 383/121; 383/907; 206/457; 493/210; D9/305

(58) Field of Search ..... 383/104, 121, 383/907, 38, 3, 121.1, 122, 901; 206/522, 457; D9/305; 493/210

(56) References Cited

U.S. PATENT DOCUMENTS

| | | | | | |
|---|---|---|---|---|---|
| D39,516 | S | | 6/1908 | Prugh | |
| 2,070,747 | A | * | 2/1937 | Orstrom | 229/104 |
| 2,232,088 | A | * | 2/1941 | Waters | 383/122 |
| 3,051,368 | A | * | 8/1962 | Schneider et al. | 383/209 |
| 3,074,612 | A | | 1/1963 | Schneider | |
| 3,077,295 | A | * | 2/1963 | Whiteford | 383/94 |
| 3,259,296 | A | * | 7/1966 | Beranger | 229/5.5 |
| 3,486,666 | A | | 12/1969 | Herzig et al. | |
| 3,810,503 | A | | 5/1974 | Lewis et al. | |
| 4,020,988 | A | * | 5/1977 | Kipp | 229/104 |
| 4,094,457 | A | * | 6/1978 | Spillson | 229/109 |
| 4,361,235 | A | | 11/1982 | Gautier | |
| D274,602 | S | | 7/1984 | Vangedal-Nielsen | |
| 4,795,271 | A | | 1/1989 | Lane, Jr. et al. | |
| 4,886,373 | A | | 12/1989 | Corella | |
| D308,164 | S | | 5/1990 | Cazes | |
| 4,981,257 | A | * | 1/1991 | Radbruch | 229/193 |
| D343,573 | S | | 1/1994 | Shadrach et al. | |
| 5,411,203 | A | | 5/1995 | Bochet et al. | |
| 5,860,743 | A | | 1/1999 | Larkin et al. | |
| 6,047,817 | A | | 4/2000 | Taylor et al. | |
| 6,164,822 | A | | 12/2000 | Beer | |
| 6,220,756 | B1 | | 4/2001 | Darmstater | |
| D442,487 | S | | 5/2001 | Pruitt et al. | |
| 6,245,367 | B1 | | 6/2001 | Galomb | |
| 6,265,038 | B1 | | 7/2001 | Frisk | |
| D451,793 | S | | 12/2001 | Berman | |
| 6,644,539 | B2 | * | 11/2003 | Boyd et al. | 229/104 |

FOREIGN PATENT DOCUMENTS

| | | | | |
|---|---|---|---|---|
| EP | 000580516 A1 | * | 1/1994 | 383/907 |

* cited by examiner

*Primary Examiner*—Jes F. Pascua
(74) *Attorney, Agent, or Firm*—Drinker Biddle & Reath LLP

(57) ABSTRACT

A free-standing flexible pouch is disclosed which includes a front panel, a rear panel and a bottom panel. The panels are attached to one another so as to form three or more projections. The projections each include an internal volume for containing a portion of a product in the pouch. The projections provide the pouch with a stable support for maintaining the pouch in an upright position.

28 Claims, 3 Drawing Sheets

STAND-UP POUCH WITH LEGS

FIELD OF THE INVENTION

The present invention relates to stand-up pouches formed from flexible materials for containing liquids and the like. More specifically, the present invention relates to a stand-up laminated pouch having legs formed from the flexible material for supporting the pouch in an upright position.

BACKGROUND OF THE INVENTION

Flexible pouches have widely replaced rigid containers, such as metal cans, for storing a variety of beverages and snacks. The primary reasons for this are that flexible pouches are lighter, take up less packaging space, and typically cost less to manufacture. Also, from an environmental perspective, flexible pouches take up less landfill space since they compress very easily when empty.

There are generally two forms of flexible pouches. The first type is a pillow or flat-shaped pouch. Pillow pouches are typically made from either one sheet of laminated material folded along one edge and sealed along the remaining edges, or two separate sheets of laminated material that are sealed along all four sides.

The second type of pouch is a stand-up or gusseted pouch. Stand-up pouches are generally manufactured using three sheets of laminated material that are arranged and sealed so as to form legs or supports. Typically, stand-up pouches are formed from two generally rectangular sheets of flexible laminated material, joined to a third generally oval-shaped sheet. The rectangular sheets serve as the front and back sides and the oval-shaped sheet serves as the bottom for the pouch.

Sealing of both types of bags is generally performed through a heat-sealing process. A fitment may also be incorporated into the pouch for ease of dispensing. Alternately, a straw may be manually inserted into the pouch to permit dispensing. One example of a conventional stand-up flexible pouch is disclosed in U.S. Pat. No. 5,860,743 to Larkin, et al.

As discussed above, the packaging of fluids and semi-solid products in stand-up pouches has greatly increased in recent years due to the light weight of these packages and their inherent flexibility as compared with their rigid counterpart packages. Many children who take lunches to school generally have beverages that are contained in flexible stand-up pouches.

While there are various stand-up pouches known in the prior art, these conventional pouches are often unstable when resting on a supporting surface. For example, when resting on a table the limited stability of these pouches makes them highly prone to wobbling or toppling when subjected to even a minimal degree of external contact. This can be a significant problem when the packages contain beverages for children.

A need, therefore, exists for an improved flexible package which provides increased stability.

SUMMARY OF THE INVENTION

It is an object of the present invention to provide a flexible pouch for holding contents, such beverages or semi-solid food products, where the pouch is designed to minimize rocking, tilting or wobbling when filled and resting on a support surface.

Another object of the present invention is to provide a flexible pouch that is light, easy to handle and has potential for providing amusement for a children.

These and other objects and advantages are achieved by the stand-up pouch according to the present invention. The stand-up pouch includes front, rear and bottom panels. The pouch is formed with a shape that has a tapered top and two sets of legs that extend out from the front and rear of the pouch base. In forming the pouch, the front and rear panels are notched at the bottom edge to form leg extensions. The bottom panel is folded in half and includes notches on either side that conform to the notched bottoms of the front and rear panels. The front and rear panels are joined to the bottom panel through a heat sealing or similar process around the periphery of their respective edges. As a result, the notches create load bearing projections when the panels are attached to one another.

The projections have an inner volume for storing a portion of the contents. When the volume is filled, the contents add weight and stiffness to the pouch which serve to support the pouch in a standing position. Hence, the projections increase the stability of the pouch especially on irregular surfaces and even when the pouch is partially full.

The pouch of the present invention may have graphics or other indicia applied to the projections which represent appendages such as arms or legs. Such depictions would increase the potential amusement value of the pouch for children.

The pouch may include various types of opening or dispensing features such as fitments, reclosable zipper-type openings, frangible seals, straws, etc.

The foregoing and other features and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE DRAWINGS

Figure 1:
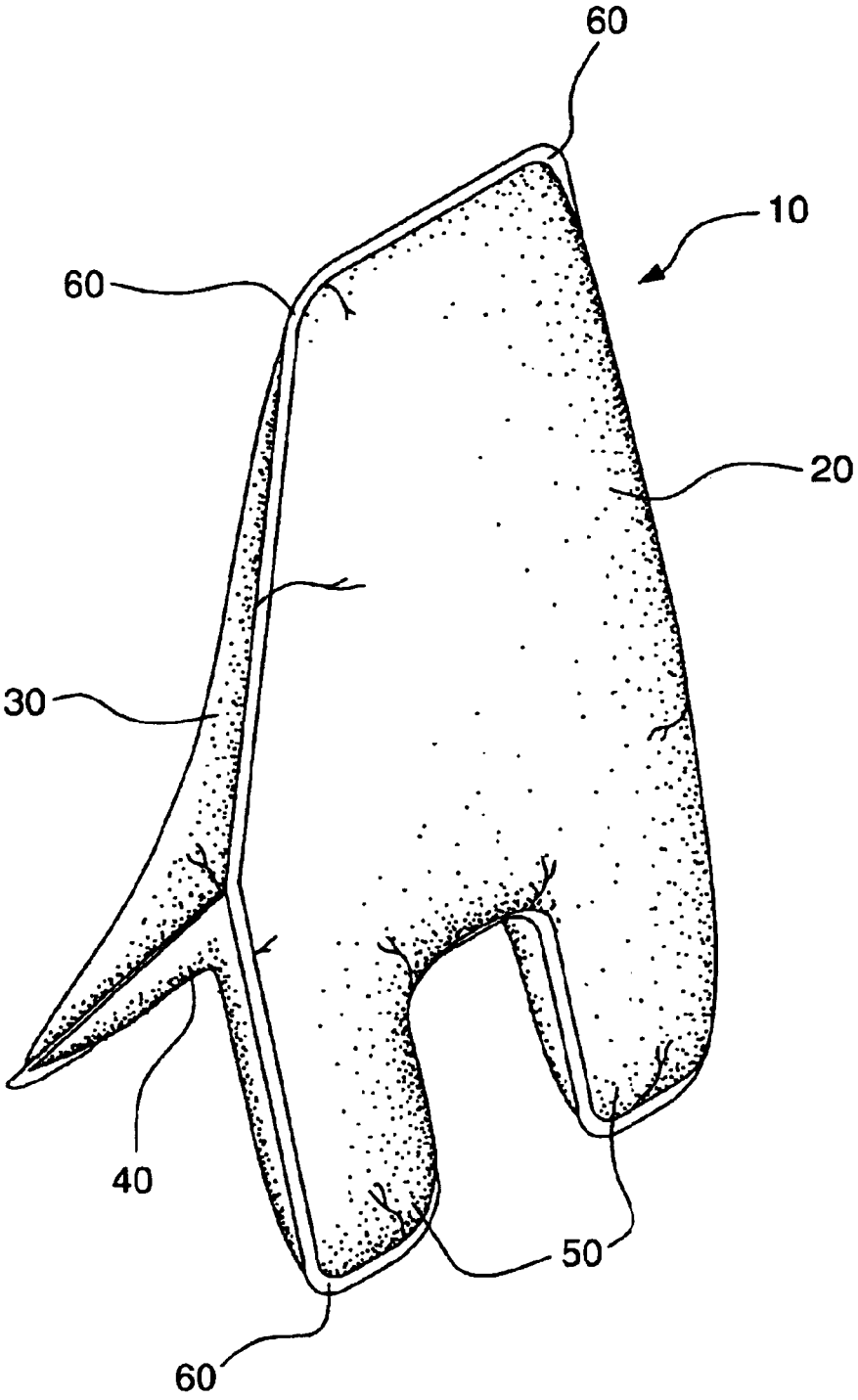
FIG. 1 is an isometric view of a pouch according to a preferred embodiment of the present invention.
Figure 2:
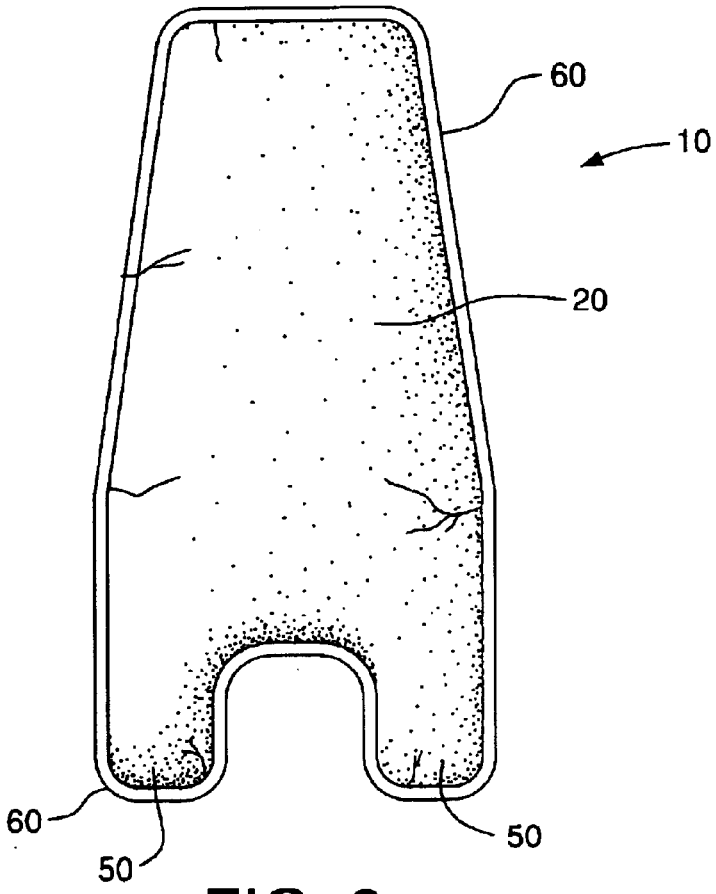
FIG. 2 is a frontal view of the pouch shown in FIG. 1.
Figure 3:
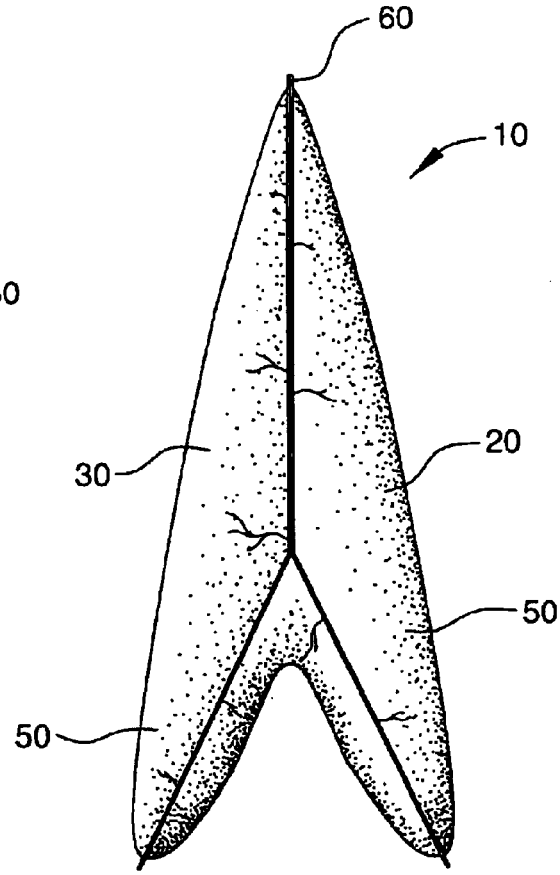
FIG. 3 is a side view of the pouch shown in FIG. 1.
Figure 5:
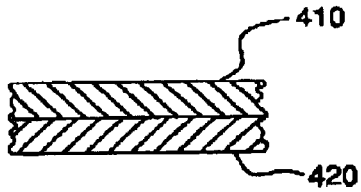
FIG. 5 is a partial cross-section of a panel illustrating an embodiment of the laminate.

Referring to the drawings, wherein like numerals identify like elements throughout the drawings, there is shown in FIG. 1 a stand-up pouch 10 according to a preferred embodiment of the invention. The pouch 10 is designed to be filled with liquids, such as beverages, pasty media or slurries, fine granular material or any other suitable material. It is contemplated however that the flexible pouch of the present invention will primarily be used as a beverage or semi-solid food container. As shown in FIG. 1, the pouch 10 includes a front panel 20, a rear panel 30 and a bottom panel 40, which combined define an enclosure. The panels are preferably made from a heat sealable, heat-weldable or ultrasonic sealable flexible laminate such as an aluminum sheet 420 covered with a plastic material 410 (FIG. 5.), although other suitable materials conventionally used to form pouches can be substituted for the aluminum sheet laminate. Those skilled in the art would be readily capable of selecting such suitable materials to use in making a pouch according to the present invention. Preferably, the front panel 20 is joined to the rear panel 30 and bottom panel 40 by heat welding along the periphery of the panel edges to form a seam 60.

In one embodiment, the front panel 20 and rear panel 30 are shaped in an "A" configuration, that is having a tapered top and two "legs" 50 at the bottom. In this embodiment, the bottom panel 40 is shaped like an "H" with two pairs of opposed legs. Each pair of legs of the bottom panel are aligned with and sealed to the legs 50 on the front and back panels 20, 30 as shown. The resulting pouch will thus have four legs which project downward from the main body of the pouch. The configuration of the pouch is such that the legs or load bearing projections 50 define small, sealed enclosures which hold a small amount of the contents of the package. The close location of the seals act to stiffen the legs so that they provide support for and stabilize the pouch.

Figure 4A:
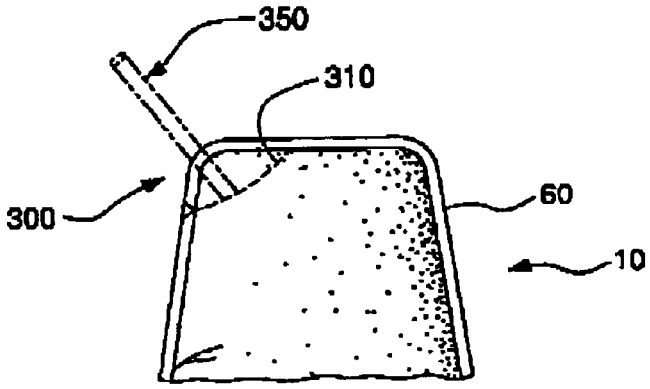
FIGS. 4A–4C illustrate various dispensers for use with the present invention.
Figure 4B:
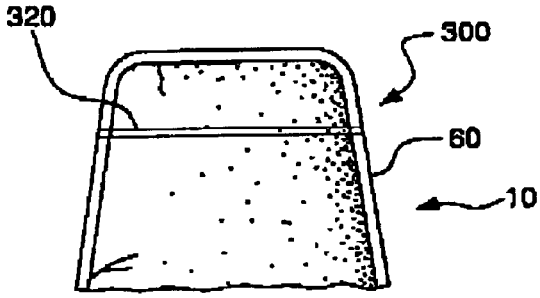
Figure 4C:
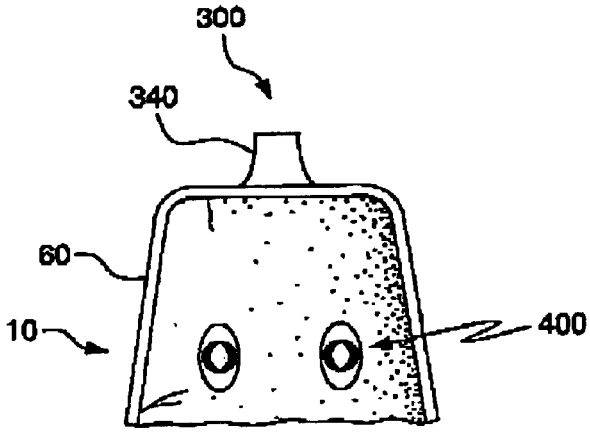

A fitment 340 or a frangible seal 310 where a straw 350 (shown in phantom in FIG. 4A) may be inserted may be incorporated into the pouch to facilitate dispensing. Alternately, or in addition, the pouch may have a tear-open section 310 at the top for dispensing. It is further contemplated that the pouch may be formed with a tear-open section which houses a drinking straw or small spoon. Since at least a portion of the load bearing projections may contain some of the contents of the pouch, it is contemplated that the package would be squeezed to force the contents in the projections to the location of the dispenser 300. It is also contemplated that a one-way valve can be included in packages containing products to be microwaved.

Graphics or similar indicia 400 may be applied to the outer surface of the front and/or back of the pouch which depict a variety of items, such as animals, cartoon characters, dinosaurs, etc. The graphics can be applied such that the load bearing projections appear to be legs on the graphic figure.

In another embodiment (not shown), the pouch may have three load bearing projections formed as a tripod for stabilizing the container. In this embodiment, either the front or rear panel has two legs and the other panel only one. The bottom portion is shaped like a "V" with three extensions designed to align with the three legs on the front and back panels. The front, rear and bottom sections are joined by heat sealing as described above, thus forming a pouch with three load bearing projections. As in the above embodiment, the resulting three legged pouch may also include a suitable dispensing device.

It is also contemplated that one or more of the load bearing projections may be heat sealed so as to form crimped extensions. The crimps would function as rigid supports for the pouch. In this embodiment, the legs would not include much of an interior cavity for containing a portion of the contends.

The invention being thus described, it will be obvious that the same may be varied in many ways. Such variations are not to be regarded as a departure from the spirit and scope of the invention, and all such modifications as would be obvious to one skilled in the art are within the scope of the following claims.

What is claimed is:

1. A free-standing flexible pouch comprising a front panel, a rear panel and a bottom panel;

a notch formed along one edge of the front panel and a notch formed along one edge of the bottom panel, wherein;

a portion of peripheral edges of the front and rear panels are sealingly attached to one another;

the notched edge of the front panel is sealingly attached to the notched edge of the bottom panel to form projecting legs from the front panel, a cavity being formed between the front and bottom panels in each of the legs, the cavity extending below the remainder of the bottom panel; and the free edge of the bottom panel is sealingly attached to the free edge of the rear panel so as to form at least a third projecting leg, the third leg including an interior cavity which includes a portion of the volume of the entire pouch.

2. A free-standing pouch as in claim 1, wherein the panels are made from a flexible laminate.

3. A free-standing pouch as in claim 2, wherein the flexible laminate includes an aluminum sheet layer and a plastic sheet layer.

4. A free-standing pouch as in claim 1, wherein the front and rear panels each comprise a top end and a bottom end, the top ends including a tapered portion and the bottom end including the notch, wherein the front and rear panels each have lateral sides and wherein the notch in each of the front and rear panels is inward from the lateral sides so as to locate each projecting leg between the notch and one of the lateral sides.

5. A free-standing pouch as in claim 4, wherein the bottom panel comprises notches arranged to align with the notches of the front and rear panels.

6. A free-standing pouch as in claim 5, wherein the front and rear panels are joined to the bottom panel around a portion of the periphery of their respective edges so as to form an enclosure able to receive a product.

7. A free-standing pouch as in claim 6, wherein the front, rear and bottom panels are joined by heat sealing.

8. A free-standing pouch as in claim 6, wherein the front, rear and bottom panels are joined by ultrasonic welding.

9. A free-standing pouch as in claim 6, wherein the front, rear and bottom panels are joined by an adhesive.

10. A free-standing pouch as in claim 6, wherein the introduction of product into the load bearing projections provides increased stability forte pouch.

11. A free-standing pouch as in claim 1, wherein the pouch further comprises a dispenser for dispensing a product from said pouch.

12. A free-standing pouch as in claim 11, wherein the dispenser is selected from a group consisting of a fitment, a reclosable zipper, a frangible seal, and a straw.

13. A free-standing pouch as in claim 1 wherein indicia are formed on the front and rear panels.

14. A free-standing pouch as in claim 13 wherein the indicia formed on the front and rear panels represent an animal.

15. A free-standing flexible pouch for containing a product, comprising a front panel, a back panel and a bottom panel, a notch formed along one edge of the front panel and a notch formed along one edge of the bottom panel, wherein:

a portion of peripheral edges of the front end back panels are sealingly attached to one another;

the notched edge of the front panel is sealingly attached to the notched edge of the bottom panel to form first and second projecting legs front panel, an interior cavity being formed between the front and bottom panels in each of the first and second legs, the interior cavity extending below the remainder of the bottom panel, the cavities in the first and second legs being designed to support the pouch when filled with a product; and the free edge of the bottom panel is sealingly attached to the free edge of the back panel so as to form at least a third projecting leg, the third leg including an interior cavity which includes a portion of the volume of the entire pouch.

16. A free-standing pouch as in claim 15, wherein when filled with a product the legs are able to support the pouch in an upright position.

17. A free-standing pouch as in claim 15, wherein the panels are made from a flexible laminate.

18. A free-standing pouch as in claim 17, wherein the flexible laminate includes an aluminum sheet layer and a plastic sheet layer.

19. A free-standing pouch as in claim 15, wherein the front and back panels each include a top end and a bottom end, each top end including a tapered portion and each bottom end including the notch, the notches in the front and back panels forming the first and second legs when sealed to the bottom panel.

20. A free-standing pouch as in claim 19, wherein the bottom panel includes notches arranged to align with the notches of the front and rear panels.

21. A free-standing pouch as in claim 20, wherein the front and back panels are joined to the bottom panel around a portion of the periphery of the their respective edges so as to form an enclosure able to receive a product.

22. A free-standing pouch as in claim 21, wherein the front, back and bottom panels are joined by heat sealing.

23. A free-standing pouch as in claim 21, wherein the front, back and bottom panels are joined by sonic welding.

24. A free-standing pouch as in claim 21, wherein the front, back and bottom panels are joined by an adhesive.

25. A free-standing pouch as in claim 21, wherein the introduction of a product to the pouch and legs increases the stability to the pouch.

26. A free-standing pouch as in claim 15, wherein the pouch further comprises a dispenser for dispensing a product from the pouch.

27. A free-standing pouch as in claim 26, wherein the dispenser is selected from a group consisting of a fitment, a reclosable zipper, a frangible seal, and a straw.

28. A method of forming a free-standing pouch comprising the steps of providing a front panel, a rear panel and a bottom panel;

forming a notch along one edge of at least the front and bottom panels;

sealing a portion of the peripheral edges of the front panel and rear panel to one another;

sealing the notched edge of the front panel to the notched edge of the bottom panel to form projecting legs from the front panel, the sealing of the notched edges creating a cavity between the front and bottom panels in each leg, the cavity extending below the remainder of the bottom panel, the cavities in the legs designed to support the pouch when filled with a product; and sealing the free edge of the bottom panel to the free edge of the rear panel so as to form at least a third projecting legs, the third legs including an interior cavity which includes a portion of the volume of the entire pouch.

* * * * *